US006803552B1

(12) United States Patent
Irizarry et al.

(10) Patent No.: US 6,803,552 B1
(45) Date of Patent: Oct. 12, 2004

(54) MICROWAVE FOOD COVERING ASSEMBLY

(76) Inventors: Ivonne U. Irizarry, 210 Sandra Ave., Brandon, FL (US) 33510; Wilfredo Irizarry, 210 Sandra Ave., Brandon, FL (US) 33510

( * ) Notice: Subject to any disclaimer, the term of this patent is extended or adjusted under 35 U.S.C. 154(b) by 0 days.

(21) Appl. No.: 10/718,011

(22) Filed: Nov. 21, 2003

(51) Int. Cl.[7] ..... H05B 6/80

(52) U.S. Cl. ..... 219/732; 219/734; 219/762; 99/DIG. 14; 229/199

(58) Field of Search ..... 219/734, 732, 219/735, 762, 725, 763; 99/DIG. 14; 426/241, 243; 299/199; 229/199

(56) References Cited

U.S. PATENT DOCUMENTS 4,498,586 A * 2/1985 Vitale ..... 206/525
4,700,843 A 10/1987 Cohen
4,801,773 A * 1/1989 Hanlon ..... 219/735
5,028,754 A * 7/1991 Chiba ..... 219/734
5,077,050 A * 12/1991 Wall ..... 426/124
5,173,070 A 12/1992 Gould
5,509,601 A 4/1996 Drabick
D416,436 S 11/1999 Miller
6,100,514 A 8/2000 Davis
6,325,234 B1 12/2001 Legaspi
6,439,529 B1 8/2002 Wong

* cited by examiner

*Primary Examiner*—Philip H. Leung

(57) ABSTRACT

A microwave food covering assembly includes a stand that includes panel having a top side and a bottom side. Each of a plurality of legs is attached to and extends downwardly from the bottom side. Each of the legs is positioned generally adjacent to a peripheral edge of the panel. A covering includes a top wall and a peripheral wall that is attached to and extends downwardly therefrom. The top wall has generally the same shape as the panel. The top wall has a shortest diameter having a length greater than a shortest diameter of the panel. The stand may be positioned over food and the covering positioned over the stand such that the peripheral wall extends downward.

16 Claims, 4 Drawing Sheets

MICROWAVE FOOD COVERING ASSEMBLY

BACKGROUND OF THE INVENTION

1. Field of the Invention

The present invention relates to food covering devices and more particularly pertains to a new food covering device for preventing the splattering of food against the interior walls of a microwave oven while food is being cooked therein.

2. Description of the Prior Art

The use of food covering devices is known in the prior art. While these devices fulfill their respective, particular objectives and requirements, the need remains for a device that is readily positionable over food to be cooked in a microwave such that the food is covered and the microwave protected from splattering while ensuring that the food is not touched with the device. Such a device should also have the added benefits of keeping food warm and for preventing access to the food from insects.

SUMMARY OF THE INVENTION

The present invention meets the needs presented above by providing a stand that is positionable over food to be cooked in a microwave. The stand supports a disposable covering that acts as a tent positioned over the food. The stand prevents the covering from abutting the food to be covered. After use of the covering, it may be disposed of and replaced with another covering.

The present invention also protects food to be served from insects and also retains the heat of the food within the covering to keep the food warm.

To this end, the present invention generally comprises a stand that includes panel having a top side and a bottom side. Each of a plurality of legs is attached to and extends downwardly from the bottom side. Each of the legs is positioned generally adjacent to a peripheral edge of the panel. A covering includes a top wall and a peripheral wall that is attached to and extends downwardly therefrom. The top wall has generally the same shape as the panel. The top wall has a shortest diameter having a length greater than a shortest diameter of the panel. The stand may be positioned over food and the covering positioned over the stand such that the peripheral wall extends downward.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
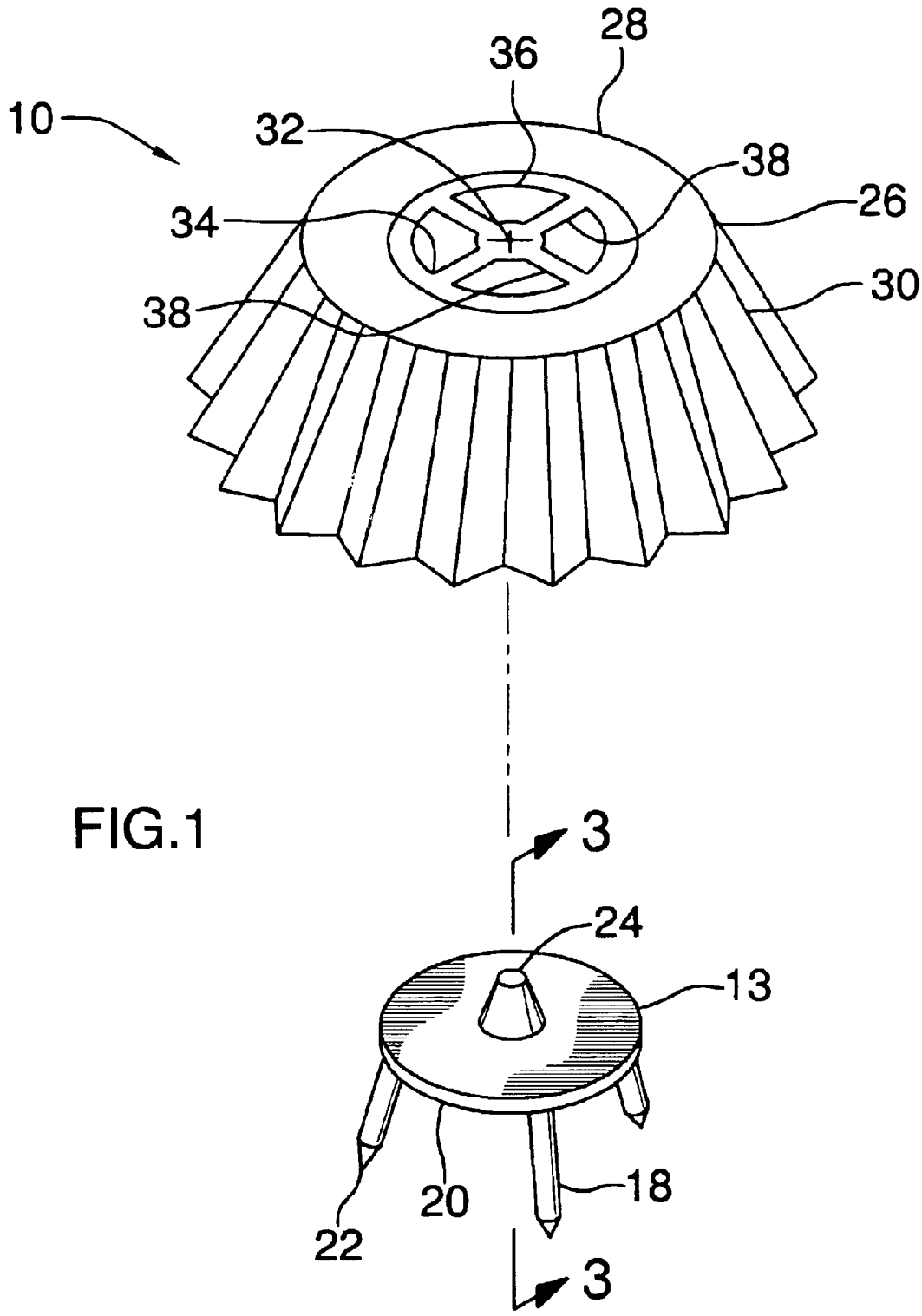
FIG. 1 is a schematic perspective view of a microwave food covering assembly according to the present invention.
Figure 2:
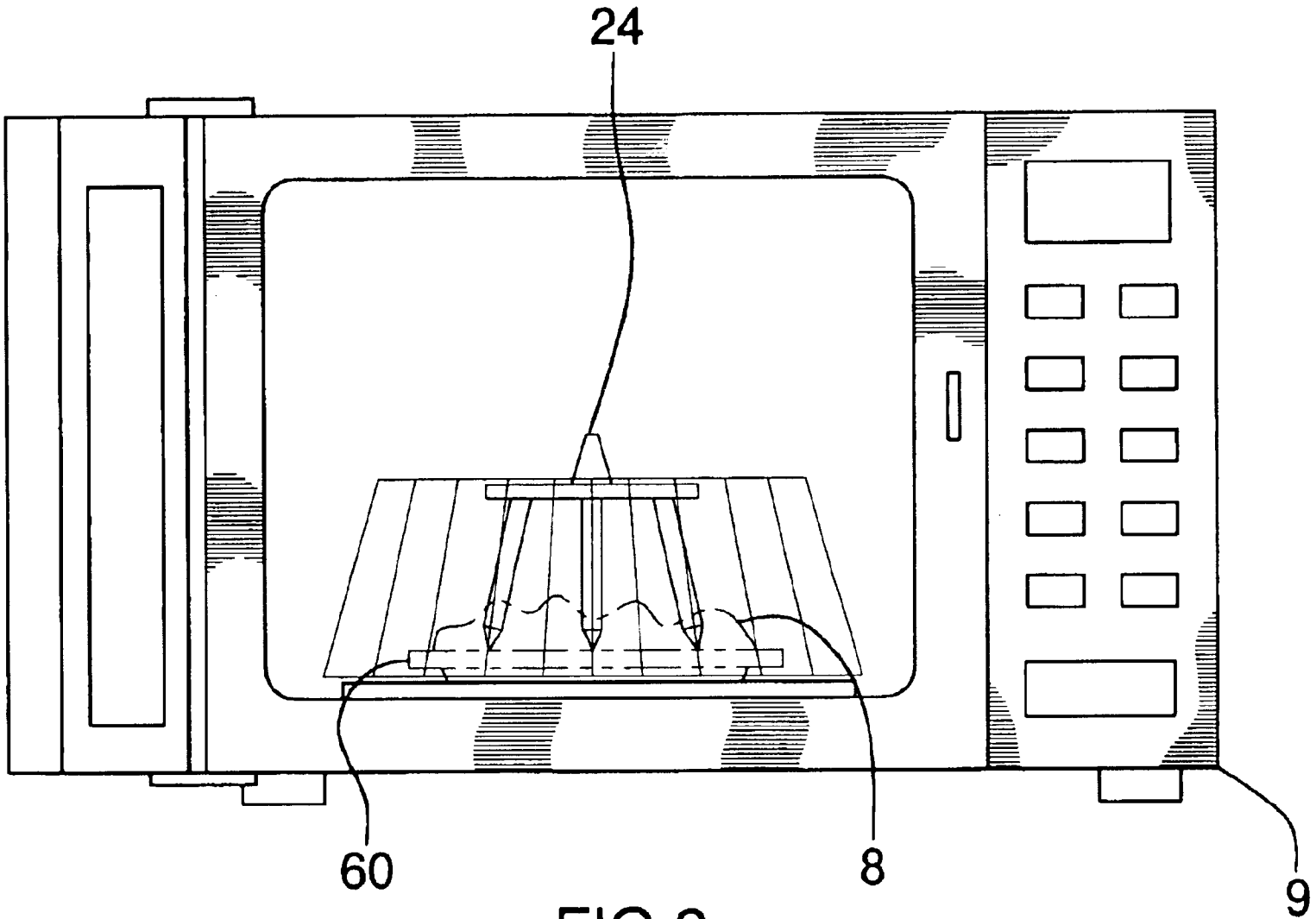
FIG. 2 is a schematic front in-use view of the present invention.
Figure 3:
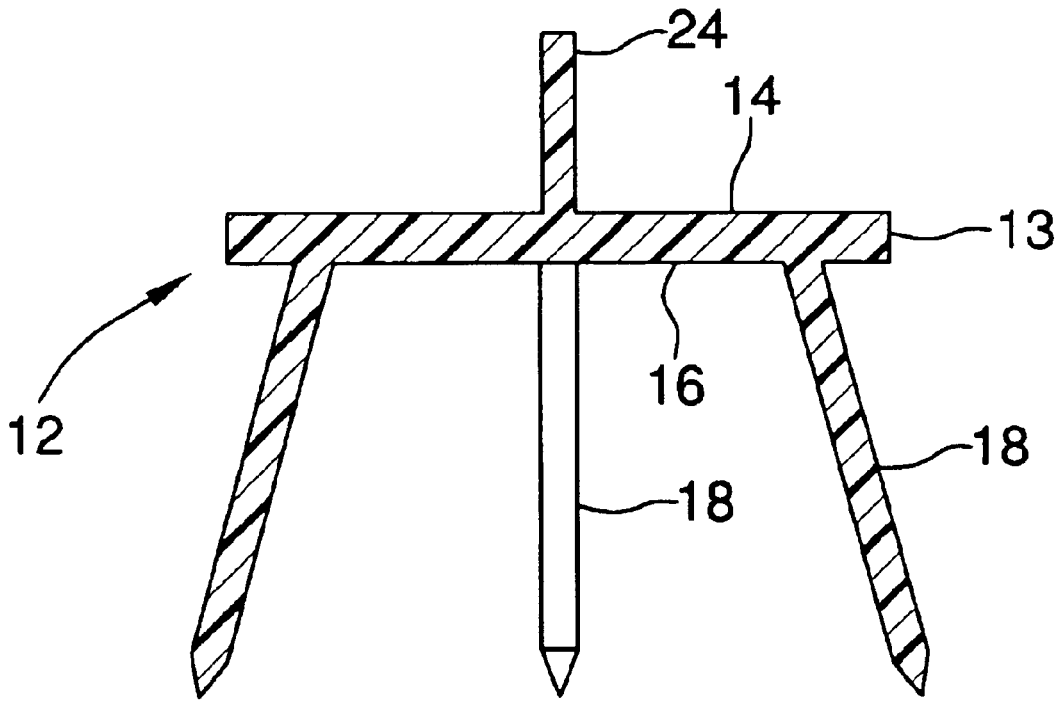
FIG. 3 is a schematic cross-sectional view taken along line 3—3 of FIG. 1 of the present invention.
Figure 4:
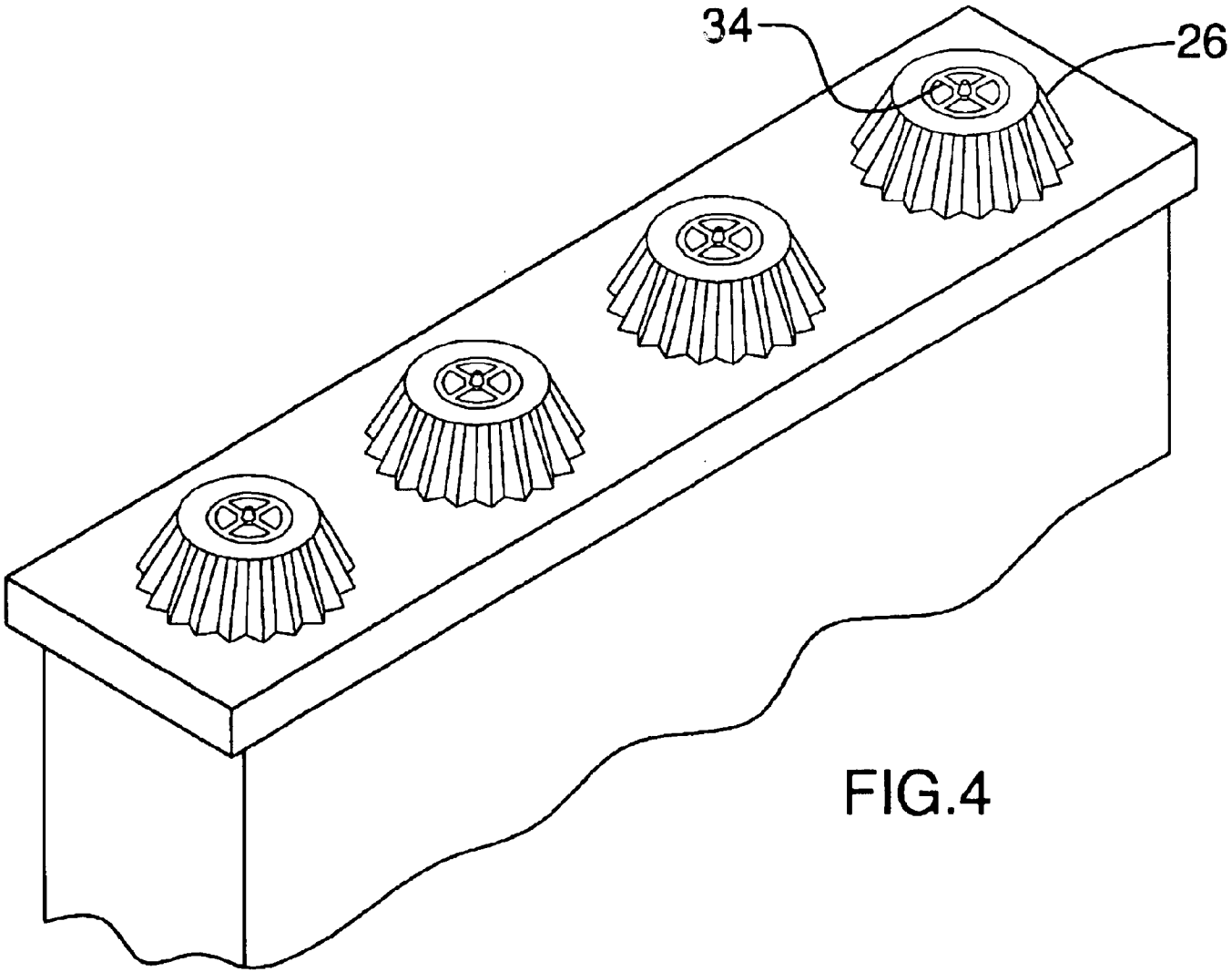
FIG. 4 is a perspective view of a plurality of coverings and stands of the present invention.

With reference now to the drawings, and in particular to FIGS. 1 through 4 thereof, a new food covering device embodying the principles and concepts of the present invention and generally designated by the reference numeral 10 will be described.

As best illustrated in FIGS. 1 through 4, the microwave food covering assembly 10 generally comprises a stand 12 that includes panel 13 having a top side 14 and a bottom side 16. Each of a plurality of legs 18 is attached to and extends downwardly from the bottom side 16. Each of the legs 18 is positioned generally adjacent to a peripheral edge 20 of the panel 13. The legs 18 are generally equidistant from each other and are preferably angled outwardly with respect to each other. The legs 18 each have a pointed bottom end 22. The panel 13 preferably has a substantially circular shape and a diameter generally between 1 ½ inches and 2 inches, though variations of this may exist. The plurality of legs 18 is ideally three legs each having a height greater than 2 inches. A handle 24 is attached to and extends upwardly from the panel 13. The handle is centrally disposed on the top side 14 and preferably comprises a vertically orientated rod. The stand 12 and handle 24 are preferably comprised of a plastic material.

A covering 26 includes a top wall 28 and a peripheral wall 30 that is attached to and extends downwardly from the top wall 28. The top wall 28 has generally the same shape as the panel 13. However, it is preferred that a shortest diameter of the top wall 28 has a greater length than a shortest diameter of the panel 13. Ideally, it is preferred that that the top wall 28 have a diameter generally equal to the diameter of a plate 60 over which the covering 26 will be positioned for reasons which will become clear below. This allows for variations in shape of the panel 13 while ensuring that the top wall 28 has greater overall peripheral size than the panel 13. The peripheral wall 30 is angled outwardly such that the covering 26 substantially has a frusto-conical shape. The covering 26 is flexible and the peripheral wall 30 is pleated to add strength to the peripheral wall. Ideally, the covering 26 comprises a flexible material which may include a paper material or a thin transparent plastic material. The top wall 28 has an opening 32 therein for removably receiving the handle 24. The peripheral wall 30 has height greater than the height of the legs 18 and ideally a height within between ⅛ inch and 1 inch of the height of the legs 22.

Ideally, a reinforcing frame 34 is attached to the top wall 28. The opening 32 extends through the frame 34 for removably receiving the handle. The frame 34 preferably includes a perimeter wall 36 and centrally located arms 38 that cross each other. The opening 32 is located at a juncture of the arms 38. The reinforcing frame 34 is preferably comprised of a substantially rigid material such as a plastic or cardboard.

In use, wherein the stand 12 is to be positioned over food 8, preferably located on a plate 60, to be cooked in a microwave oven 9 and the covering 26 is positioned over the stand 12 such that the peripheral wall 30 extends downward. The top wall has a diameter at least as large as the plate 60 to ensure that the peripheral wall 30 does not enter the food 8. The legs 18 are angled outwardly to provide a greater amount of space between the legs 18 for placement of the food 8 and they provide for greater balance of the stand. The pointed lower ends 22 of the legs 18 provide less surface area for food 8 to adhere to when they are positioned in the food 8. The peripheral wall 30 has a height more than the legs 18 so that it may be draped over the edges of the plate to prevent the splattering of the food 8 onto an interior surface of the microwave oven 9. The assembly 10 may also be placed over food 8 that is about to be served for retaining its heat or for keeping insects and the like away from the food 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A food cover assembly for positioning over food being cooked in a microwave oven, said assembly comprising:

a stand including panel having a top side and a bottom side, a plurality of legs being attached to and extending downwardly from said bottom side, each of said legs being positioned generally adjacent to a peripheral edge of the panel;

a covering including a top wall and a peripheral wall being attached to and extending downwardly therefrom, said top wall having generally the same shape as said panel, said top wall having a shortest diameter having a length greater than a shortest diameter of said panel;

a handle being attached to and extending upwardly from said panel, said top wall of said covering having an opening therein for removably receiving said handle; and wherein said stand may be positioned over food and said covering positioned over said stand such that said peripheral wall extends downward.

2. The food cover assembly of claim 1, wherein each of said legs is angled outwardly.

3. The food cover assembly of claim 1, wherein each of said legs has a pointed bottom end.

4. The food cover assembly of claim 1, wherein said panel has a substantially circular shape.

5. The food cover assembly of claim 4, wherein said peripheral wall is angled outwardly such that said covering has a frusto-conical shape.

6. The food cover assembly of claim 1, wherein said plurality of legs includes three legs.

7. The food cover assembly of claim 1, wherein said handle is centrally disposed on said top side.

8. The food cover assembly of claim 1, wherein said peripheral wall is angled outwardly.

9. The food cover assembly of claim 1, wherein said covering is flexible.

10. The food cover assembly of claim 9, wherein said peripheral wall is pleated.

11. The food cover assembly of claim 10, wherein said covering comprises a paper material.

12. The food cover assembly of claim 11, wherein said peripheral wall has height greater than a height of said legs.

13. The food cover assembly of claim 10, wherein said covering comprises a plastic material.

14. The food cover assembly of claim 13, wherein said peripheral wall has height greater than a height of said legs.

15. The food cover assembly of claim 1, wherein said peripheral wall has height greater than a height of said legs.

16. A food cover assembly for positioning over food being cooked in a microwave oven, said assembly comprising:

a stand including panel having a top side and a bottom side, a plurality of legs being attached to and extending downwardly from said bottom side, each of said legs being positioned generally adjacent to a peripheral edge of the panel, said legs being generally equidistant from each other, each of said legs being angled outwardly, each of said legs having a pointed bottom end, said panel having a substantially circular shape, said plurality of legs being three legs;

a handle being attached to and extending upwardly from said panel, said handle being centrally disposed on said top side;

a covering including a top wall and a peripheral wall being attached to and extending downwardly therefrom, said top wall having generally the same shape as said panel, said top wall having a shortest diameter having a greater length than a shortest diameter of said panel, said peripheral wall being angled outwardly such that said covering has a frusto-conical shape, said covering being flexible, said peripheral wall being pleated, said covering comprising a flexible material, said top wall having an opening therein for removably receiving said handle, said peripheral wall having height greater than a height of said legs;

a reinforcing frame being attached to said top wall, said opening extending through said frame; and wherein said stand may be positioned over food and said covering positioned over said stand such that said peripheral wall extends downward.

* * * * *